United States Patent [19]

Kruse

[11] 4,058,861

[45] Nov. 22, 1977

[54] CABINET

[76] Inventor: Eckart Kruse, Hirzlistrasse, Uznach (Kt. St. Gallen), Switzerland, 8730

[21] Appl. No.: 658,106

[22] Filed: Feb. 13, 1976

[30] Foreign Application Priority Data

Sept. 18, 1975 Switzerland ..... 12133/75

[51] Int. Cl.[2] ..... A47C 19/00

[52] U.S. Cl. ..... 5/164 R; 5/2 R; 312/314; 312/315

[58] Field of Search ..... 5/164 R, 164 B, 164 C, 5/164 D, 164 E; 312/138 R, 138 A, 237

[56] References Cited

U.S. PATENT DOCUMENTS

| | | | |
|---|---|---|---|
| 517,357 | 3/1894 | Murphy | 5/164 D |
| 1,016,139 | 1/1912 | Gillespie | 5/164 R |
| 1,054,894 | 3/1913 | Ball | 5/164 R |
| 1,366,482 | 1/1921 | Osterud | 5/164 R |
| 1,400,534 | 12/1921 | Ernest | 5/164 B |
| 1,815,358 | 7/1931 | Manville | 5/164 C |
| 2,085,832 | 7/1937 | Shochet | 312/138 R |
| 2,747,202 | 5/1956 | Driver | 5/164 R |
| 3,805,307 | 4/1974 | Foufounis et al. | 5/164 R |
| 3,828,375 | 8/1974 | Driver | 5/164 C |
| 3,851,344 | 12/1974 | Beithammer | 5/164 D |

FOREIGN PATENT DOCUMENTS

| | | | |
|---|---|---|---|
| 1,146,916 | 1957 | France | 5/164 R |

*Primary Examiner*—Paul R. Gilliam
*Assistant Examiner*—Victor N. Sakran
*Attorney, Agent, or Firm*—Karl F. Ross

[57] ABSTRACT

A cabinet-type bed comprises a cabinet having a pair of sidewalls upon which a bed frame is hingedly received to enable it to swing from an upright position within the cabinet into a position in which the ends form the cabinet. The pivots include a pin extending through the frame and into a housing therewithin, the pin carrying a segment with a curved edge to which a chain is anchored at one end. The chain runs over a pulley fixed in the housing and terminates in a holder attached to the wall of the housing opposite the idler by a first spring. The holder is also engageable by an end of a second spring after a certain travel to tension this second spring when the bed is swung out of the cabinet, the first spring being continuously tensioned by the chain during such swinging movement.

3 Claims, 5 Drawing Figures

CABINET

This invention relates to a cabinet having a door hinged at the bottom and an inside part, such as a bed or bath, that can be lowered against the force of springs.

SUMMARY OF THE INVENTION

The cabinet according to the invention differs from those of the type known heretofore in that provision is made of a plurality of springs joined to the inside part at one end and a fixed part of the cabinet at the other, and so constructed and arranged as to be placed under tension in stages as the inside part is lowered. Some of the springs are tensioned only when the inside part is swung out so far that the action of the springs already under tension is no longer sufficient to hold the inside part in equilibrium.

The invention has the advantage that the inside part retains its position in any degree of inclination, and can be lowered out of the cabinet into the position for use or raised back into the cabinet when no longer needed with a minimum of physical effort.

BRIEF DESCRIPTION OF THE DRAWING

The accompanying drawing shows by way of example a preferred embodiment of the invention, and wherein.

SPECIFIC DESCRIPTION

Figure 1:
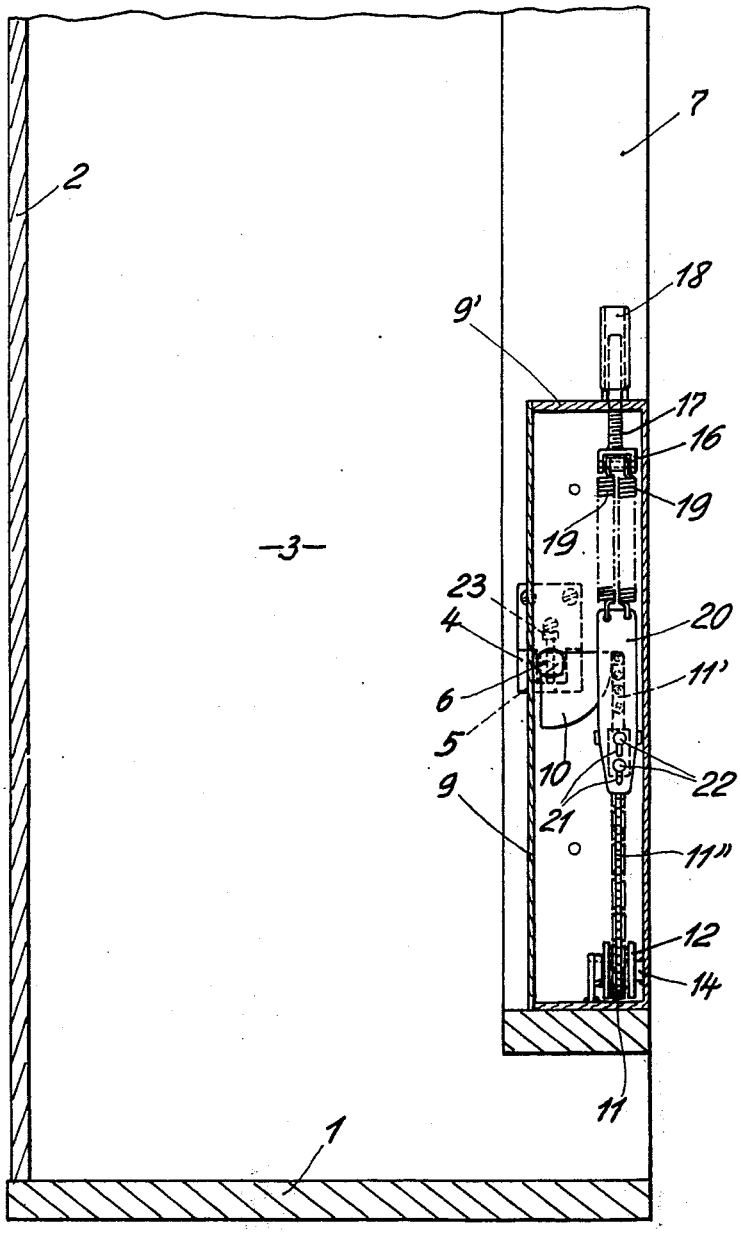
FIG. 1 is a vertical cross section through part of a cabinet accommodating a bed.
Figure 2:
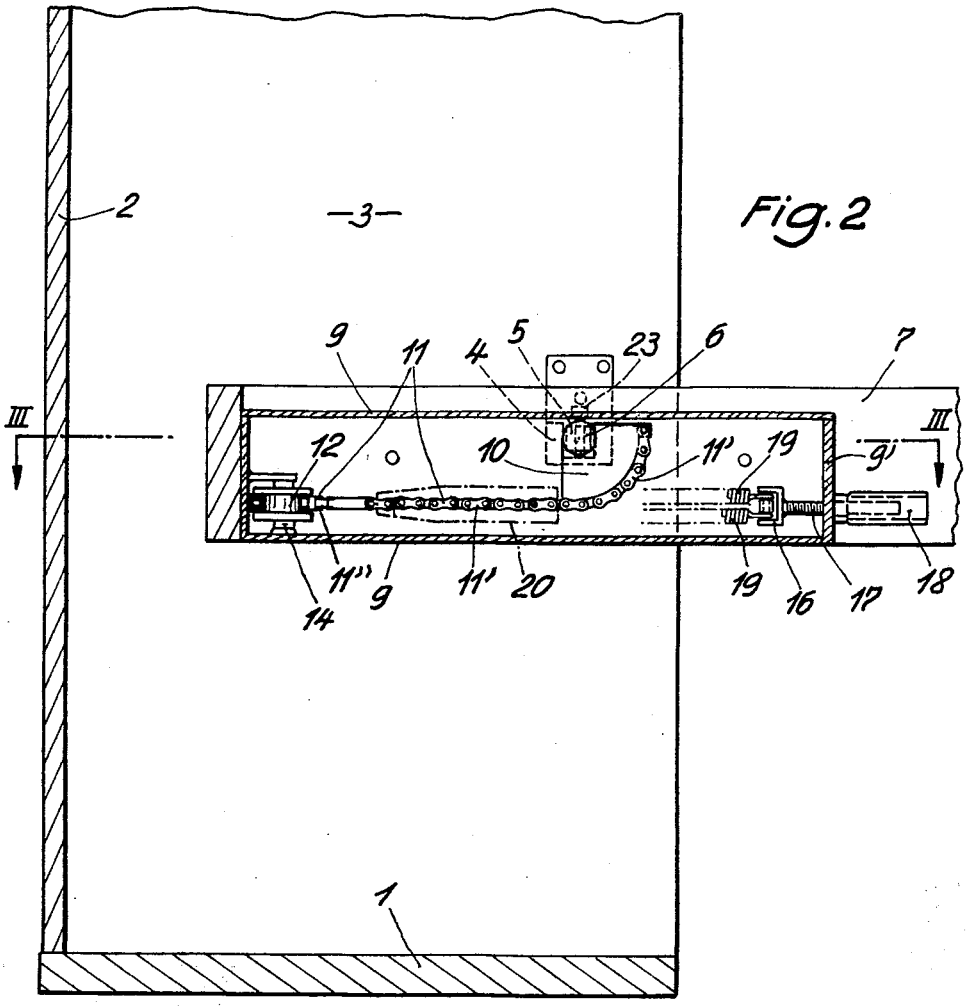
FIG. 2 is a vertical cross section through part of a cabinet bed with the bed hinged out into the position for use.

In said drawing the cabinet has a bottom 1 a back 2 and a side 3. The inside of each side wall of the cabinet has fixed thereto a substantially U-shaped support 4 (only one shown) which is open at the top. In each support 4 a horizontal hinge pin 6 is carried, secured against turning by its square ends 5. The hinge pin 6 shown acts as one of the two pivots for the bed and passes through the longitudinal frame member 7 of the bed in a bearing bush 8. This bearing bush 8 is fixed to a housing 9 which is screwed to the inside of the adjacent longitudinal frame member 7 of the bed. Fixed on the inner end of the hinge pin 6 is a segment 10 having one end of a roller draw chain 11 fastened to an end of its curved edge so that the length 11'' of the chain can be unrolled or taken up. The chain 11 runs over a return pulley 12 to a holder 13 having the other end of the chain fastened thereto. Return pulley 12 turns on a journal 14 arranged inside the housing 9 within the bed frame 7. Springs 15 are fastened at one end to holder 13, while at the other end they engage — via a connecting piece 16 — a threaded spindle 17. The latter threadedly receives a nut 18 in the form of a hand grip 18, braced against the abutment 9' of housing 9. Further (second) springs 19 are likewise attached to the connecting piece 16 at one end, but their other ends are fastened to links 20 each having a slot 21 in which the pins 22 of the holder 13 fit with clearance.

Figure 3:
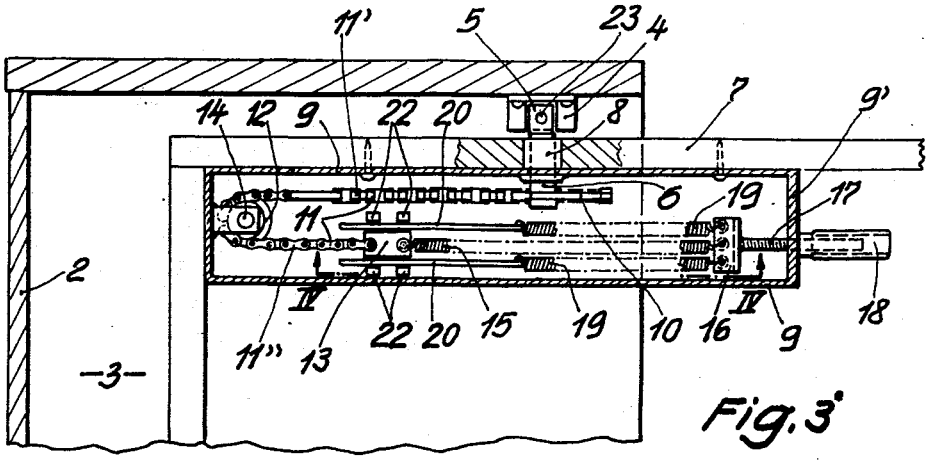
FIG. 3 is a horizontal cross section of part of one side of the bed taken on the line III—III of FIG. 2.
Figure 4:
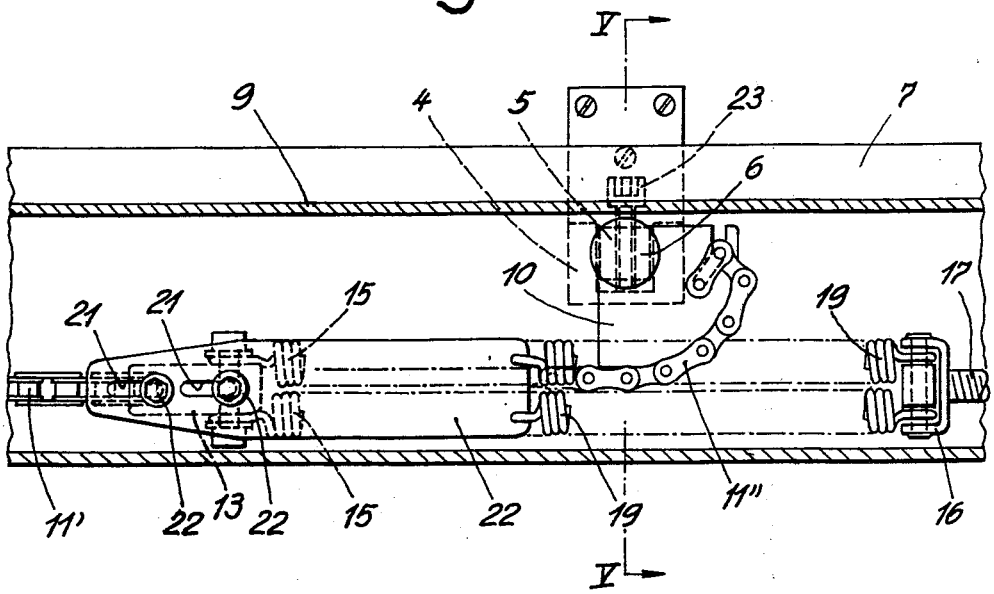
FIG. 4 is a sectional view taken along the line IV—IV of FIG. 3 on an enlarged scale.
Figure 5:
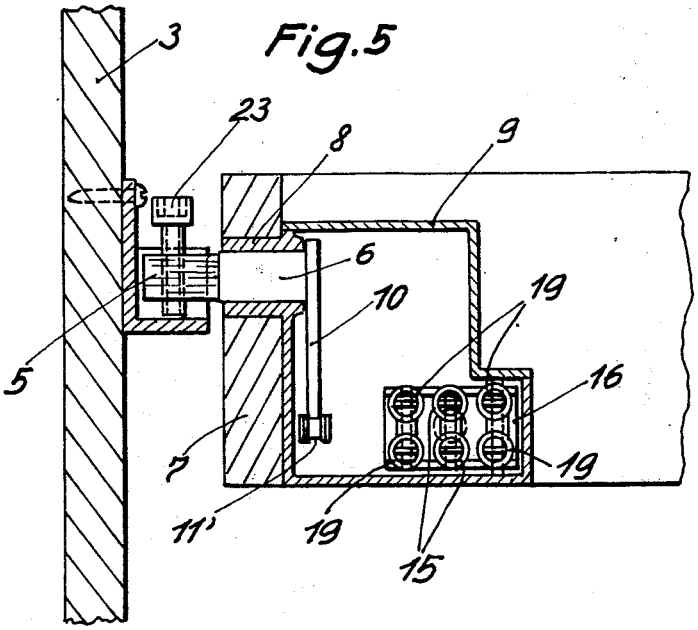
FIG. 5 is a sectional view taken on the line V—V of FIG. 4.

The square end 5 of the hinge pin 6 has a screw 23 (FIG. 5) passsing vertically therethrough, its threaded shank resting on the web of support 4. FIG. 3 shows part of a longitudinal bed frame member 7 with the bed swivelling and supporting mechanism fixed thereto. The bed frame member opposite longitudinal member 7 is fitted with a similar swivelling and supporting mechanism, though in mirror-image layout. This is not shown in the drawing. By turning the screws 23 the hinge pins 6 can be adjusted into a common horizontal plane. To keep the bed in the horizontal position after lowering it, at the front end of the bed (not shown) there is a support extending down to the floor and hinging away into the bed when this is raised. The front and underside of the bed are enclosed in familiar fashion, so that they are flush with the rest of the cabinet when the bed is raised.

By turning the hand grip 18 the springs 15 can be adjusted so as to exert a small pressure on the raised bed, retaining same in the raised position. In this state the roller chain forms a straight line between its attachment point on segment 10 and return pulley 12. When the bed is swung out, the chain is progressively taken up onto segment 10, with the result that the chain length 11 between return pulley 12 and fixing point on segment 10 becomes longer, while at the same time the chain center 11' becomes shorter, so that the first springs 15 are subject to additional tension. The second springs 19 are not tensioned at first, because the pins 22 are able to move in the slots 21 of the links 20 for a time. Only when the bed has been tilted so far that the pins 22 come up against the ends of the slots 21 will the springs 19 be subject to tension also. The springs are thus tensioned in stages: two stages in the example described. It is of course possible however to make the springs come into action in more than two stages, if necessary.

What I claim is:

1. A cabinet-type bed assembly which comprises:

a cabinet formed with a pair of sidewalls flanking an opening;

a bed frame pivotally mounted on said sidewalls and swingable relative to said cabinet between an upright position wherein said bed frame is received in said cabinet and a prone position wherein said bed frame extends from said cabinet through said opening;

a housing received in said bed frame;

a pivot swingably supporting said bed frame on one of said sidewalls and including a nonrotatable pin extending into said housing;

a segment fixed on said pin in said housing and having an arcuate surface therein;

means on said cabinet securing said pin and said segment against rotation;

an elongated traction member in the form of a chain anchored to said segment and adapted to be taken up and paid out from said surface, said traction member having an end remote from said segment;

a holder affixed to said end of said elongated traction member in said housing;

At least one first tension spring anchored at one end to said holder and at another end to said housing;

at least one second tension spring having one end engageable with said holder upon takeup of said elongated traction member by said segment to tension said second spring, said second spring having another end affixed to said housing, said housing having a pair of spaced-apart walls; and a pulley mounted on one of said walls, said elongated traction member extending around said pulley, said other ends of said springs being anchored to the other of said walls.

2. The assembly defined in claim 1 wherein said means securing said pin includes an upwardly open support on said one of said sidewalls, said pin having a square end received in said support and a screw threaded into said square end for vertical adjustment of said pin relative to said support, at least two such first springs being affixed to said holder and said other walls and at least two such second springs being provided, said second springs have their said other ends attached to respective links provided with slots, said holder having pins slidably received in said slots.

3. The assembly defined in claim 2 wherein said outer ends of all of said springs are attached to a common plate, said assembly further comprising a spindle affixed to said plate and extending through said other wall and a nut rotatable externally of said housing threaded onto said spindle and bearing against said other wall of said housing.

* * * * *